US007852277B2

(12) United States Patent
Lam

(10) Patent No.: US 7,852,277 B2
(45) Date of Patent: Dec. 14, 2010

(54) CIRCULARLY POLARIZED HORN ANTENNA

(75) Inventor: Tommyhing-K H. Lam, Apalachin, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 472 days.

(21) Appl. No.: 11/890,014

(22) Filed: Aug. 3, 2007

(65) Prior Publication Data

US 2009/0033579 A1 Feb. 5, 2009

(51) Int. Cl.
*H01Q 13/00* (2006.01)

(52) U.S. Cl. ..... 343/785; 343/786

(58) Field of Classification Search ..... 343/786, 343/785, 772, 756
See application file for complete search history.

(56) References Cited

U.S. PATENT DOCUMENTS

| | | | | |
|---|---|---|---|---|
| 2,946,999 | A | 7/1960 | Kelleher et al. | |
| 3,055,004 | A | 9/1962 | Cutler | |
| 4,021,814 | A | 5/1977 | Kerr et al. | |
| 4,047,180 | A | 9/1977 | Kuo et al. | |
| 4,258,366 | A | 3/1981 | Green | |
| 4,658,258 | A | 4/1987 | Wilson | |
| RE32,485 | E * | 8/1987 | Yang et al. | 343/786 |
| 4,897,663 | A * | 1/1990 | Kusano et al. | 343/786 |
| 5,305,001 | A | 4/1994 | Wong et al. | |
| 5,642,121 | A * | 6/1997 | Martek et al. | 343/786 |
| 5,841,404 | A | 11/1998 | Yen | |
| 5,883,604 | A * | 3/1999 | Nicely | 343/786 |
| 5,907,309 | A | 5/1999 | Anderson et al. | |
| 6,025,809 | A | 2/2000 | Lane et al. | |
| 6,208,310 | B1 | 3/2001 | Suleiman et al. | |
| 6,323,819 | B1 | 11/2001 | Ergene | |
| 6,329,957 | B1 | 12/2001 | Shea et al. | |
| 6,501,432 | B2 * | 12/2002 | Yuanzhu | 343/772 |
| 6,580,400 | B2 * | 6/2003 | Sato et al. | 343/785 |
| 6,720,932 | B1 | 4/2004 | Flynn et al. | |
| 6,937,202 | B2 | 8/2005 | Chandler | |
| 6,937,203 | B2 | 8/2005 | Rao et al. | |
| 2001/0011933 | A1 * | 8/2001 | Enokuma | 333/135 |
| 2001/0026242 | A1 * | 10/2001 | Sato et al. | 343/786 |
| 2002/0008669 | A1 | 1/2002 | Muhlhauser et al. | |
| 2003/0030590 | A1 * | 2/2003 | Gau et al. | 343/786 |
| 2004/0222934 | A1 | 11/2004 | Wu | |
| 2005/0116781 | A1 | 6/2005 | Yamamoto et al. | |
| 2005/0237253 | A1 | 10/2005 | Kuo et al. | |
| 2006/0050004 | A1 | 3/2006 | Hsiu et al. | |

FOREIGN PATENT DOCUMENTS

| | | |
|---|---|---|
| GB | 2 090 068 A | 6/1982 |

* cited by examiner

*Primary Examiner*—HoangAnh T Le
(74) *Attorney, Agent, or Firm*—Wolf, Greenfield & Sacks, P.C.

(57) ABSTRACT

In some embodiments, a circularly polarized horn antenna may include a circular polarizer having a step shape. In some embodiments, a circularly polarized horn antenna may include a choke that is offset in position with respect to the antenna aperture. Such antennas may have a relatively constant beamwidth with respect to frequency, compact size, and/or low weight.

20 Claims, 3 Drawing Sheets

CIRCULARLY POLARIZED HORN ANTENNA

BACKGROUND

1. Technical Field

The techniques described herein relate to a circularly polarized horn antenna and to antenna components including a circular polarizer having a step-shaped portion and a choke offset from the antenna aperture.

2. Discussion of Related Art

Conventional horn antennas are used for transmission and reception of radio waves. Radio waves are electromagnetic waves having a frequency within the range of about several Hz to several hundreds of GHz. A conventional horn antenna may include a slab polarizer having a pyramid-like or conical shape that tapers down to a point at the antenna aperture. One problem with such slab polarizers is that they are typically both long and heavy. Another problem with conventional horn antennas is that their beamwidth decreases as frequency increases.

One alternative to a horn antenna is a spiral antenna which can provide a frequency-independent beamwidth. However, when spiral antennas are designed to operate at frequencies that have a small corresponding wavelength, the size of the antenna winding may be so small that it is difficult to manufacture. Further, because the windings are so tight in such spiral antennas, electrical arcs may occur between the windings when exposed to high power electromagnetic environments. Another drawback of spiral antennas is that their gain is inherently less than that of horn antennas, particularly when spiral antennas are loaded with an absorber to enhance operational bandwidth.

SUMMARY

Some embodiments relate to a horn antenna that includes a waveguide and a circular polarizer coupled to the waveguide. The circular polarizer comprises a slab of dielectric material having a first portion of a first width and a second portion of a second width smaller than the first width such that the slab has a step shape. The second portion of the slab of smaller width is positioned at an aperture of the horn antenna.

Some embodiments relate to a horn antenna that includes a choke displaced from an aperture of the horn antenna by a distance of between $0.55\lambda_{center}$ and $0.61\lambda_{center}$ inclusive. In this case, $\lambda_{center}$ is defined as the wavelength of a radio wave at the center frequency of a radio frequency band upon which the horn antenna is designed to operate.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
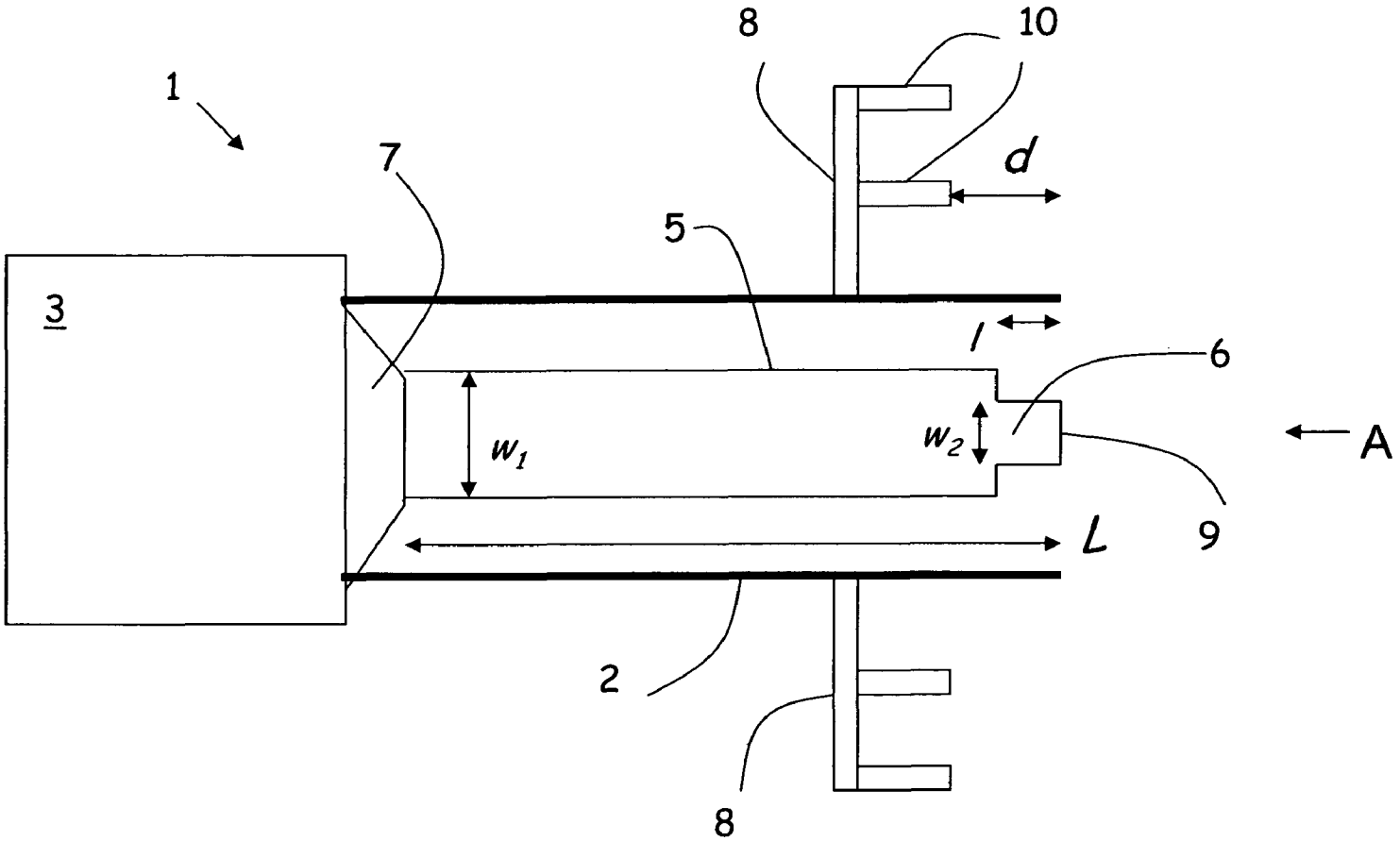
FIG. 1 is a side-view of a horn antenna, according to some embodiments.

Some embodiments of the invention are directed to a circularly polarized horn antenna. In some embodiments, such a horn antenna may be used in military applications such as electronic warfare support measures (ESM) and electronic attack (EA) systems. Circularly polarized horn antennas may be desirable for such applications because they can detect radio waves of any polarization with high gain, or transmit a focused high-power beam, for example. It should be appreciated that the horn antenna is not limited to use in military applications, as the invention is not limited in this respect. Indeed, the antenna may be used in a wide variety of applications, such as, for example, medical applications (e.g., such as RF imaging and/or diagnoses), wireless communication applications or any other suitable application.

In military applications, (e.g., ESM and EA systems) the horn antenna may be used to transmit and/or detect radar waves. Radar waves are radio waves that may be used for the detection and/or location of objects, for example. A horn antenna may have a conductive body with an opening at one end, known as the antenna aperture. The aperture is the position at which electromagnetic radiation, such as radar waves, are emitted and/or received by the antenna. Received radar waves pass through the aperture and may be coupled to a polarizer within the cavity and then passed on to a waveguide for coupling to a reception circuit. When mounted on an airplane, for example, a horn antenna can be used to detect radar waves emitted from enemy installations, vehicles or missiles.

Antennas may be directional such that they receive radar waves differently depending on the angle at which the radar waves impinge upon the antenna. For example, for aperture antennas the best reception may occur for radar waves that are incident on the antenna aperture in a direction normal (i.e., perpendicular) to the plane of the aperture. Less efficient reception may occur at different angles, as the amount of power coupled to the antenna may be reduced. An antenna that can detect radar waves coming from a relatively wide range of angles is said to have a relatively large beamwidth, and an antenna that can only detect radar waves coming from a relatively narrow range of angles is said to have a relatively small beamwidth. The antenna beamwidth is conventionally defined with respect to the angles for which the antenna will receive at least some fraction (e.g., −3 dB) of the signal power for radio waves incident on the antenna. At other angles of incidence, the antenna may receive a smaller amount of the signal power, and may be unable to effectively detect such radar waves.

Because a single horn antenna may only receive radar from directions encompassed by the antenna's beamwidth, multiple antennas may be mounted on the aircraft to detect radar coming from different directions. Multiple antennas may also be used to determine the angle at which radar is incident upon the aircraft. For example, if an incoming enemy missile uses radar to track an aircraft, the angle of arrival of the incoming missile can be determined based on the angle at which the radar waves from the missile are incident upon the aircraft's antenna(s). Since the strength of the signal received may depend on the angle of arrival, the relative strength of radar signals received may be used to determine the angle of arrival of the incoming missile.

As discussed above, one problem with conventional horn antennas is that they have a beamwidth that decreases with increasing frequency. Thus, multiple arrays of conventional horn antennas have been used to effectively detect radar over a range of radio frequencies, with each antenna array being dedicated to a particular radar frequency band. This approach may necessitate a large number of antennas, which may be particularly cumbersome for airborne applications due to the corresponding increase in space and weight. In some embodiments, horn antennas implemented according to the techniques described herein may have a relatively constant beamwidth over a broad frequency range, thus reducing or eliminating the need for multiple antenna arrays for different frequency ranges. In some embodiments, such horn antennas may have a relatively compact size and low weight.

In some embodiments, a horn antenna includes a circular polarizer having a step-like shape which is coupled to a waveguide. For example, in some embodiments the circular polarizer may include a slab-shaped piece of dielectric material having a portion of larger width closer to the waveguide and a portion of smaller width further from the waveguide. In addition, the circular polarizer may be shaped such that the transition between the portion of larger width to the portion of smaller width occurs in one or more steps at which the width of the dielectric slab changes abruptly.

Figure 2:
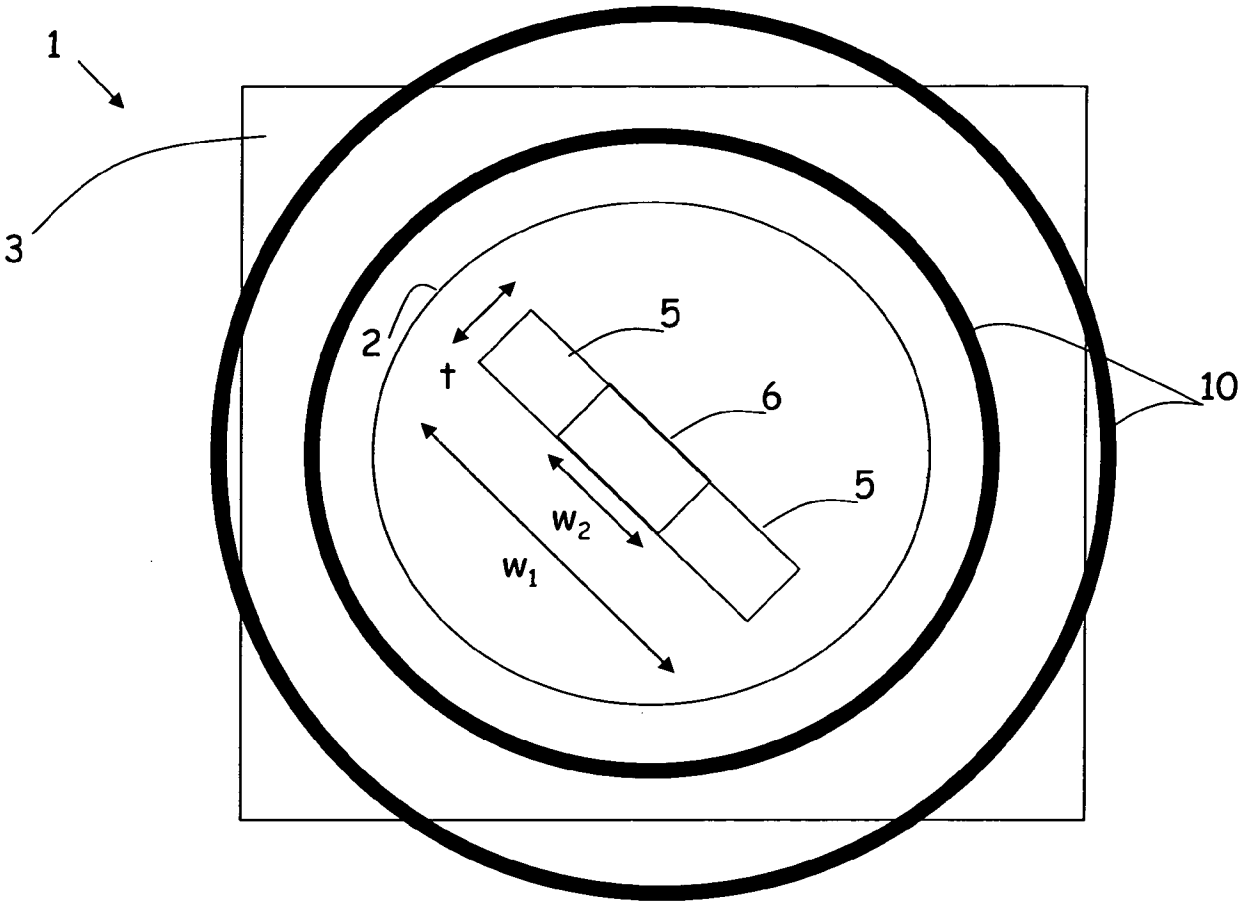
FIG. 2 is an end-view of the horn antenna illustrated in FIG. 1.

FIG. 1 illustrates a cross-sectional side view of a horn antenna having such a circular polarizer. Horn antenna 1 includes a body 2, an interface unit 3, a circular polarizer 5 that includes a step portion 6, a circular-to-rectangular waveguide transition 7 and a choke 8. Radio waves may be transmitted and/or received via antenna aperture 9. FIG. 2 shows an end-view of horn antenna 1 from the point of view of arrow—A—shown in FIG. 1.

Circular polarizer 5 may be configured to transmit circularly polarized radio waves and/or to receive radio waves having any polarization. This may be done in any suitable way, as the invention is not limited in this respect. For example, in some embodiments, when horn antenna 1 is receiving radio waves, the received radio waves may be polarized by circular polarizer 5 such that a linearly polarized wave is provided to a rectangular waveguide via circular-to-rectangular waveguide transition 7. If linearly polarized radio waves are received by circular polarizer 5, their polarization may be transformed to a different linear polarization by circular polarizer 5 for coupling to a rectangular waveguide. Such a transition may incur, for example, with a power loss of approximately 3 dB. If circularly polarized radio waves are received by circular polarizer 5, their polarization may be transformed to a linear polarization by circular polarizer 5 without incurring substantial power loss.

In some embodiments, circular polarizer 5 may be oriented at approximately a 45° angle with respect to the rectangular waveguide, as illustrated in FIG. 2. The effect of such an orientation may be to slow down electric or magnetic fields having a field component parallel to the slab. As electromagnetic waves propagate along the direction of the slab, their polarization may be changed due the slower propagation of certain field components compared to other field components. Circular polarizer 5 may be made of any suitable material, including, but not limited to, lexan or polycarbonate.

Circular polarizer 5 may have any suitable shape, as the invention is not limited in this respect. In some embodiments, circular polarizer 5 may include a step portion 6. Step portion 6 may have a width $w_2$ that is smaller than the width another portion of circular polarizer 5, which has a width $w_1$. In some embodiments, step portion 6 may have a width $w_2$ that is about 75% or less of width $w_1$. Step portion 6 may have approximately the same thickness t as the rest of circular polarizer 5, as illustrated in FIG. 2. In some embodiments, the length of step portion 6 may be chosen such that the circular polarizer acts as a transformer that effectively matches the impedance of air (into which the antenna radiates or receives radiation) to the impedance of a waveguide to which circular polarizer 5 is electromagnetically coupled. For example, the length of step portion 6 may be selected such the circular polarizer acts as a quarter wave transformer that matches the impedance of air to the impedance of the waveguide. Matching the impedances in such a way may provide high power transfer between the waveguide and the medium (e.g., air) upon which radio waves are transmitted and/or received. In some embodiments, step portion 6 may have substantially a cuboid shape, such that the step-portion 6 has a shape similar to a cube, but in some circumstances may differ from a cube shape such that one or more cross-section(s) of the cuboid is rectangular rather than square. However, the invention is not limited in these respects, as step portion 6 may have any suitable length, thickness, width or shape. In some embodiments, step portion 6 may be approximately centered with respect to the rest of circular polarizer 5, as illustrated in FIGS. 1 and 2. Although the embodiment illustrated in FIGS. 1 and 2 includes a circular polarizer having a step-shaped portion that includes only a single step, the invention is not limited to the use of a single step, as step portion 6 may be shaped such that it includes more than one step.

The use of a step-shaped portion having an abrupt, step-like change in width contrasts with conventional slab polarizers having conical or pyramidal shapes in which the size of the polarizer is tapered and gradually reduced to a point. As illustrated in FIGS. 1 and 2, in some embodiments the width of the circular polarizer may change abruptly at a position along the length of the circular polarizer. The effect of the reduced width of step portion 6 may be to effectively reduce the effective aperture size of antenna 1 at higher frequencies, which may counteract the tendency of the antenna beamwidth to narrow at higher frequencies. In further contrast to conventional slab polarizers, circular polarizer 5 may have a relatively small size, which may be advantageous in some applications.

In some embodiments, a circularly polarized horn antenna designed according to the techniques described herein may have a relatively constant beamwidth with respect to frequency. For example, such an antenna may be designed to operate in the frequency range of 26-40 GHz having a constant beamwidth throughout, such as a beamwidth of 90° that varies by less than 5° across the frequency range. However, the invention is not limited in this respect, as a horn antenna may be designed according to the techniques described herein to operate within any suitable radio frequency range, and may have any suitable beamwidth.

As illustrated in FIGS. 1 and 2, horn antenna 1 may include a body 2 that is attached to an interface 3. Body 2 of horn antenna 1 may be formed of any suitable material, as the invention is not limited in this respect. In some embodiments, body 2 may be formed of a conductive material such as aluminum or any other suitable metal. In some embodiments, body 2 may form an elongated cavity having a substantially circular cross-section, as illustrated in FIGS. 1 and 2. However, body 2 may be formed of any suitable material and in any suitable shape, as the invention is not limited in these respects. Interface 3 may allow for the coupling of electromagnetic energy to and/or from antenna 1 via waveguide (e.g., a rectangular waveguide). Interface 3 may convert the electromagnetic energy received from a waveguide to an electrical signal that may be provided to a reception circuit. Conversely, when used for transmission, interface 3 may convert an electrical signal from a transmission circuit into an electromagnetic wave that may be transmitted by horn antenna 1. In some embodiments, a coaxial cable may be connected to interface 3 for receiving and/or providing radio frequency signals to/from antenna 1. However, the invention not limited in this respect, as any suitable techniques may be used for coupling electrical signals to/from horn antenna 1.

In some embodiments horn antenna 1 may include a choke 8 that is offset in position by a distance d with respect to aperture 9. However, the invention is not limited in this respect, as horn antenna 1 need not include a choke 8. Horn antennas that include a choke are known in the art. However, conventional chokes have been aligned with the antenna aperture, such that the choke substantially surrounds the aperture at the end of the antenna.

In accordance with the techniques described herein, a choke may be positioned a distance d from the antenna aperture. In some embodiments, the distance d may have a value of approximately $0.58\lambda_{center}$, where $\lambda_{center}$ is the wavelength of the radio wave at the center frequency $v_{center}$ of the radio frequency band upon which the antenna is designed to operate. The relationship between the frequency v and the wavelength $\lambda$ of an electromagnetic wave is governed by the equation $c=\lambda v$, where c is the speed of light of the medium in which the electromagnetic wave propagates. Positioning the choke at $0.58\lambda_{center}$ from the antenna aperture can counteract the tendency of antenna's beamwidth to decrease at higher frequencies, as the choke's effect of confining the electrical aperture size may increase at higher frequencies. This increase of confinement makes the effective antenna aperture size decrease as the radio wave frequency increases. As a result, near constant beamwidth can be realized over frequency. To achieve such effects, the choke need not be positioned exactly a distance of $0.58\lambda_{center}$ from the antenna aperture, as suitable performance may be achieved for slightly different positions. In some embodiments, the choke may be positioned a distance of $0.58\lambda_{center}$ from the aperture within a tolerance of +/−5%. For example, the choke may be displaced from the aperture by a distance of between $0.55\lambda_{center}$ and $0.61\lambda_{center}$ inclusive.

In some embodiments, choke 8 may have one or more choke portions 10. Each choke portion may have substantially a ring shape, and may surround body 2 of antenna 1 such that each choke portion 10 is concentric with body 2. In some embodiments, choke 8 may be a quarter wave choke. However, these choke configurations are described by way of example, and other configurations are possible.

An antenna designed according to the techniques described herein may include both a step polarizer and an offset choke, a step polarizer and no offset choke, an offset choke and no step polarizer, or any other suitable combination of antenna components. As discussed above, the techniques described herein enable forming a horn antenna having a compact size and correspondingly low weight, which may be particularly advantageous for applications in which the antenna is mounted on a moving vehicle, e.g., an airplane. Additionally, such an antenna can have a relatively constant beamwidth over a relatively large frequency range.

Figure 3:
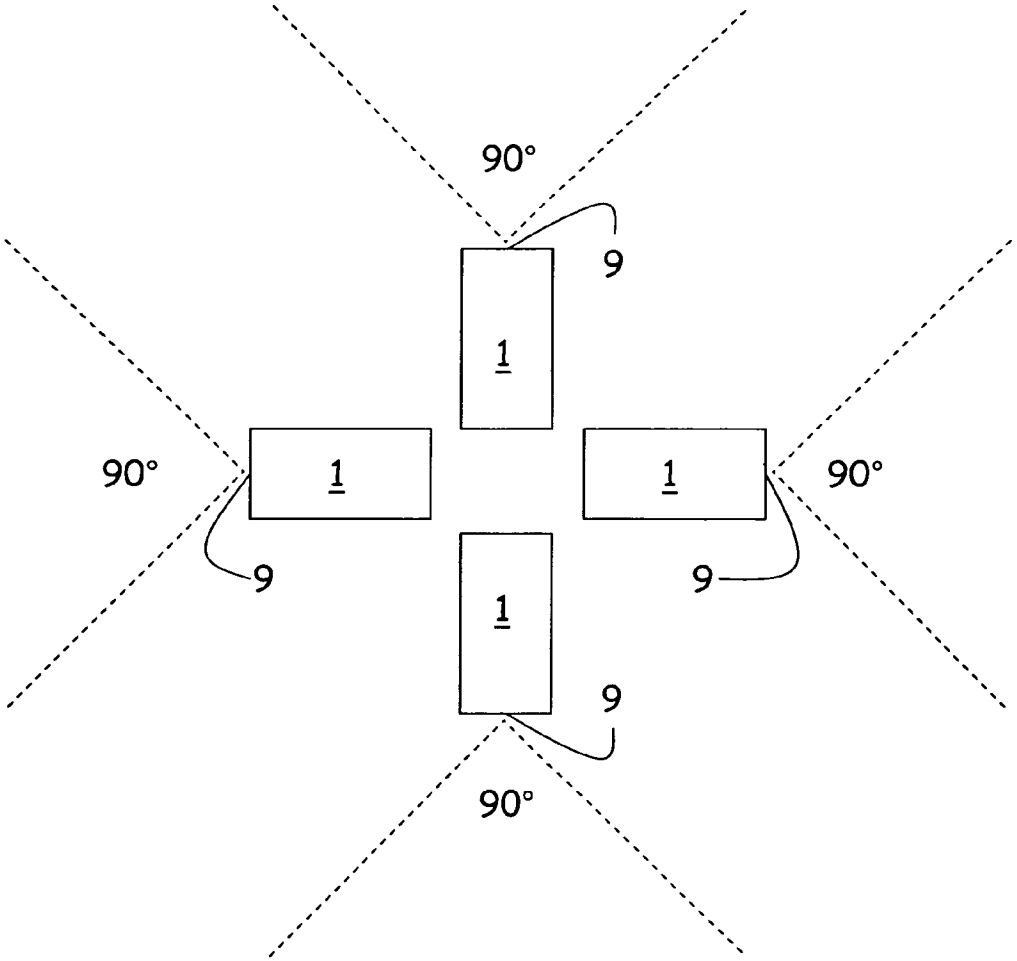
FIG. 3 shows a multiple-antenna configuration, according to some embodiments.

FIG. 3 illustrates an embodiment in which four horn antennas 1 are positioned to send and/or receive radio waves in different directions. In this embodiment, each of the horn antennas 1 may have a beamwidth of approximately 90°, and may be positioned at 90° angles from one another. As illustrated in FIG. 3, such an antenna configuration may allow for the transmission and/or reception of radio waves in directions spanning an angle of 360°. When mounted on an airplane, for example, such an antenna configuration may be used to detect enemy radar coming from any direction to the sides or rear of the aircraft. As discussed above, the angle of arrival may be determined based on the strength of the received signal, if desired. However, the invention is not limited in this respect, as a multiple antenna array may be used in any configuration and in any suitable application.

This invention is not limited in its application to the details of construction and the arrangement of components set forth in the foregoing description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A horn antenna, comprising:

a circular polarizer comprising a slab of dielectric material having a rectangular cross section, the slab having a first portion of a first width and a second portion of a second width smaller than the first width such that the slab has a step shape, the second portion of the slab being positioned at an aperture of the horn antenna, wherein the first portion of the slab has a first side and a second side, the first side and the second side being separated by the first width, and the second portion of the slab has a third side and a fourth side that are separated by a second width, wherein the second portion is positioned between the first side and the second side and displaced from the first side and the second side, wherein the second portion has a substantially flat end extending between the third side and the fourth side.

2. The horn antenna of claim 1, wherein the second width is less than about 75% of the first width.

3. The horn antenna of claim 1, wherein the second portion has a cuboid shape.

4. The horn antenna of claim 1, wherein the slab abruptly transitions from having the first width to having the second width at a boundary between the first portion and the second portion.

5. The horn antenna of claim 1, wherein the first and second portions of the slab have a same thickness.

6. The horn antenna of claim 1, wherein the second portion is centered with respect to the first portion along a direction parallel to the first and second widths.

7. The horn antenna of claim 1, further comprising:

a body having a cylindrical shape and an opening that defines a position of the aperture;

wherein the slab is positioned at least partially within the body.

8. The horn antenna of claim 7, wherein the second portion comprises a first end of the slab, wherein the first end is aligned with the opening.

9. The horn antenna of claim 7, further comprising:

an interface unit integrated with the body of the antenna.

10. The horn antenna of claim 1, further comprising:

a choke displaced from the aperture of the horn antenna by a distance of between $0.55\lambda_{center}$ and $0.61\lambda_{center}$ inclusive, where $\lambda_{center}$ is a wavelength of a radio wave at a center frequency of a radio frequency band upon which the horn antenna is designed to operate.

11. The horn antenna of claim 10, wherein the choke is displaced from the aperture along a direction normal to a plane of the aperture.

12. The horn antenna of claim 1, wherein the substantially flat end is positioned within a plane of the aperture.

13. The horn antenna of claim 1, wherein a height of the second portion of the slab is chosen such that the circular polarizer matches the impedance of a waveguide to the impedance of air.

14. The horn antenna of claim 1, wherein the horn antenna further comprises a circular-to-rectangular waveguide transition coupled to the circular polarizer.

15. The horn antenna of claim 1, wherein the horn antenna has a beamwidth that varies by less than 5° over an operating frequency range of at least 14 GHz.

16. The horn antenna of claim 15, wherein the beamwidth is about 90°.

17. A horn antenna, comprising:

a ring-shaped choke displaced from an aperture of the horn antenna by a distance of between 0. $55\lambda_{center}$ and $0.61\lambda_{center}$ inclusive, where $\lambda_{center}$ is a wavelength of a radio wave at a center frequency of a radio frequency band upon which the horn antenna is designed to operate.

18. The horn antenna of claim 17, further comprising:

a body having an opening that defines a position of the aperture.

19. The horn antenna of claim 17, wherein a portion of the ring-shaped choke nearest the aperture is positioned a distance of $0.58\lambda_{center}$ from the aperture.

20. The horn antenna of claim 17, wherein the horn antenna has a beamwidth that varies by less than 5° over an operating frequency range of at least 14 GHz.

* * * * *

UNITED STATES PATENT AND TRADEMARK OFFICE

CERTIFICATE OF CORRECTION

PATENT NO. : 7,852,277 B2
APPLICATION NO. : 11/890014
DATED : December 14, 2010
INVENTOR(S) : Tommy Lam It is certified that error appears in the above-identified patent and that said Letters Patent is hereby corrected as shown below:

On the title page, under (75) Inventor: "Tommyhing-K H. Lam" should read --Tommy Lam--.

Signed and Sealed this
Eleventh Day of June, 2013

Teresa Stanek Rea

Teresa Stanek Rea
*Acting Director of the United States Patent and Trademark Office*